United States Patent [19]

Katsumi et al.

[11] Patent Number: 4,780,073

[45] Date of Patent: Oct. 25, 1988

[54] APPARATUS FOR MELT-SPINNING THERMOPLASTIC POLYMER FIBERS

[75] Inventors: Hasegawa Katsumi; Michio Ohno, both of Kusatsu; Tadahito Nagayasu; Kazuo Umeda, both of Nagoya, all of Japan

[73] Assignee: Toray Industries, Inc., Tokyo, Japan

[21] Appl. No.: 57,784

[22] Filed: Jun. 3, 1987

Related U.S. Application Data

[62] Division of Ser. No. 745,676, Jun. 17, 1985, Pat. No. 4,702,871.

[51] Int. Cl.[4] ..... B29C 47/88

[52] U.S. Cl. ..... 425/72.2; 264/211.14; 264/211.15; 425/378.2

[58] Field of Search ..... 8/130.1; 264/101, 102, 264/211.14, 211.15, 237, 176.1, 204, 205, 348; 425/725, 378 S, DIG. 60

[56] References Cited

U.S. PATENT DOCUMENTS 3,659,980 5/1972 Fernandez ..... 425/72 S
3,707,593 12/1972 Fukada et al. ..... 264/211.14
4,340,341 7/1982 Cardell ..... 425/72 S
4,627,811 12/1986 Greiser et al. ..... 425/72 S

FOREIGN PATENT DOCUMENTS 51-11910 1/1976 Japan ..... 264/211.14

*Primary Examiner*—Jay H. Woo
*Assistant Examiner*—C. Scott Bushey
*Attorney, Agent, or Firm*—Austin R. Miller

[57] ABSTRACT

A thermoplastic polymer is melt-spun into a spinning tube decompressed to not more than 0.7 atm and withdrawn therefrom to the outer air through a narrow groove provided in a bottom sealing body which substantially seals the interior of the spinning tube from the outer air. The bottom sealing body is provided with a plurality of regulating chambers communicating with the groove, which chambers are controlled to have interior pressures of intermediate values between those of the spinning tube and the outer air, whereby the pressure pulsation of an air stream flowing into the interior of the spinning tube from the outer air through the groove can be avoided. This, in turn, ensures a smooth spinning operation and uniform yarn quality.

9 Claims, 7 Drawing Sheets

APPARATUS FOR MELT-SPINNING THERMOPLASTIC POLYMER FIBERS

This is a division of application Ser. No. 745,676 filed June 17, 1985, now U.S. Pat. No. 4,702,871.

BACKGROUND OF THE INVENTION

1. Field of the Invention

The present invention relates to a method and apparatus for stably melt-spinning thermoplastic polymer fibers having a superior uniformity and mechanical property by extruding a fiber-forming polymer into a decompressed atmosphere and then taking-up the polymer under normal atmospheric conditions.

2. Description of the Related Art

It is known in the prior art to melt-spin a fiber-forming polymer into a decompressed atmosphere. In principle, this type of spinning is advantageous in that a stable spinning operation can be carried out due to a decrease in the air resistance acting on a filament, and in that a yarn having an excellent mechanical property is obtainable due to an improvement of the skin-core structure of the filament.

Japanese Examined Patent Publication (Kokoku) No. 57-8206, discloses an apparatus in which a yarn is spun into a spinning tube having a decompressed atmosphere for minimizing any adverse influence from the ambient atmosphere on the yarn and for improving yarn uniformity. According to the prior art, in order to withdraw the yarn from the interior of the spinning tube, a yarn exit is provided in the vicinity of the bottom portion of the tube. The yarn exit comprises a plurality of sequentially arranged orifices. In this known apparatus, since filaments composing the yarn run through the spinning tube in a state in which they are separated from each other, an opening area of the yarn exit must be large enough to permit the yarn to smoothly pass therethrough. This causes a difficulty to arise of keeping the interior of the spinning tube under a high level vacuum. Further, due to the air flowing into the interior of the spinning tube through the opening of the orifice, the yarn in the spinning tube is caused to vibrate, and thus to come into contact with the orifice, which causes damage to the filaments composing the yarn from frictional wear and, in extreme cases, breakage of the filaments, thereby deteriorating the mechanical property of the resultant yarn. The above-mentioned vibration of the yarn further causes the filaments to become entangled with each other, which also disturbs the continuation of the stable spinning operation. Moreover, according to this prior art apparatus, the interior pressure of the spinning tube is at most 0.8 atm as disclosed in the example thereof.

Further to the above, in high speed spinning, since the extrusion rate of the polymer from the spinneret is necessarily increased for producing the identical yarn thickness compared to the conventional system and, coupled with this, the dwelling time of the yarn in the cooling zone is decreased due to the high speed take-up thereof, therefore, the cooling of the extruded molten polymer is insufficient before it is taken-up as a yarn. This drawback of insufficient cooling is promoted by the decompressed spinning tube because the mass of the gas in the spinning tube, which directly participates in the heat transfer from the yarn, is decreased. In addition, according to the apparatus disclosed in the above-said patent publication, the temperature of the air in the spinning tube is elevated as time passes because the heat transferred to the air from the yarn in stored therein and cooling of the yarn soon becomes difficult even if a means is provided for directly cooling the spinning tube. Further, monomer, oligomer, and catalyzer sublimated from the high temperature polymer flow tend to close the space within the spinning tube by separation and subsequent adherence to the inner wall thereof, which not only interferes with the smooth spinning operation but also degrades the effect of the heat exchange in the spinning tube.

SUMMARY OF THE INVENTION

It is a primary object of the present invention to eliminate the above drawbacks of the prior art.

It is another object of the present invention to provide a novel method and apparatus for producing a uniform yarn of thermoplastic polymer through a spinning tube kept at a decompressed pressure of not higher than 0.7 atm, in which the yarn runs smoothly at a high rate without being subjected to air resistance and obtains a better mechanical property caused by a desirable microstructure of fiber due to a gradual cooling effect.

The above object of the present invention is achieved by a method for producing a yarn from a thermoplastic polymer according to the present invention. The method includes the steps of extruding a molten polymer through a spinneret as a filament yarn into a spinning tube disposed directly beneath the spinneret, the interior of the spinning tube being kept at a pressure not higher than 0.7 atm, cooling the filament yarn to solidify it in the spinning tube, and withdrawing the filament yarn from the spinning tube through a narrow groove provided at the bottom of the spinning tube, which groove body allows a continuous passing-through of the filament yarn but maintains the above-pressure in the spinning tube the pressure in the spinning tube being preferably not more than 0.5 atm.

The thermoplastic polymer is preferably a polyester. In this case, the yarn is preferably withdrawn from the spinning tube at a speed of not less than 4,000 m/min after being cooled in the spinning tube at a temperature of lower than $(T_A+20)$°C., wherein $T_A$ stands for a temperature of the outer air. The polymer is preferably free from a $TiO_2$ content.

The polymer may be a polyamide, and, in this case, the withdrawing speed of the yarn is preferably not less than 2,500 m/min.

The above method is preferably carried out by an apparatus according to the present invention, which includes a spinning body, a spinneret connected to the spinning body in a state wherein it is substantially sealed against the ingress of the outer air and disposing the surface of the spinneret in the spinning tube, a gas extracting conduit connected to the spinning tube to maintain the interior of the spinning tube at a pressure of not more than 0.7 atm, a bottom sealing body provided at the bottom of the spinning tube in a state wherein it is substantially sealed against the ingress of the outer air, an opening provided in the bottom sealing body, a plug detachably secured to the opening in a state wherein it is substantially sealed against the ingress of the outer air, at least one groove forming the yarn path provided on the outer surface of the plug and/or the inner surface of the opening to allow the passage of the yarn but substantially to prevent the outer air from entering into the interior of the spinning tube, and means, disposed outside of the spinning tube, for withdrawing the yarn from the spinning tube.

The groove in the bottom sealing body is connected to a pressure regulating means for adjusting pressure at the portion where the pressure regulating means is connected to the groove to a pressure value in a range of from more than a pressure value of the interior of the spinning tube and less than a pressure value of the outer atmosphere of the spinning tube. Preferably, the spinning tube comprises an annular chimney encircling the yarn path at the upper portion thereof, for the introduction of a cooling gas into the spinning tube to forcibly reduce the temperature of the yarn extruded from the spinneret. Each groove preferably has a cross-sectional area of not more than 4.0 mm, more preferably, not more than 0.7 mm. A length of the groove is preferably within a range of from 2 mm to 100 mm.

The spinning tube further comprises means for collectively guiding the yarn in the vicinity of the entrance of the groove of the bottom sealing body. The bottom sealing body may comprise a plurality of the grooves.

The means for withdrawing the yarn may be a godet roller.

BRIEF DESCRIPTION OF THE DRAWINGS

Further objects and advantages of the present invention will be made more apparent from the following description with reference to the accompanying drawings illustrating the preferred embodiments of the present invention, wherein.

DESCRIPTION OF THE PREFERRED EMBODIMENTS

Overall Construction of the Apparatus

Figure 1:
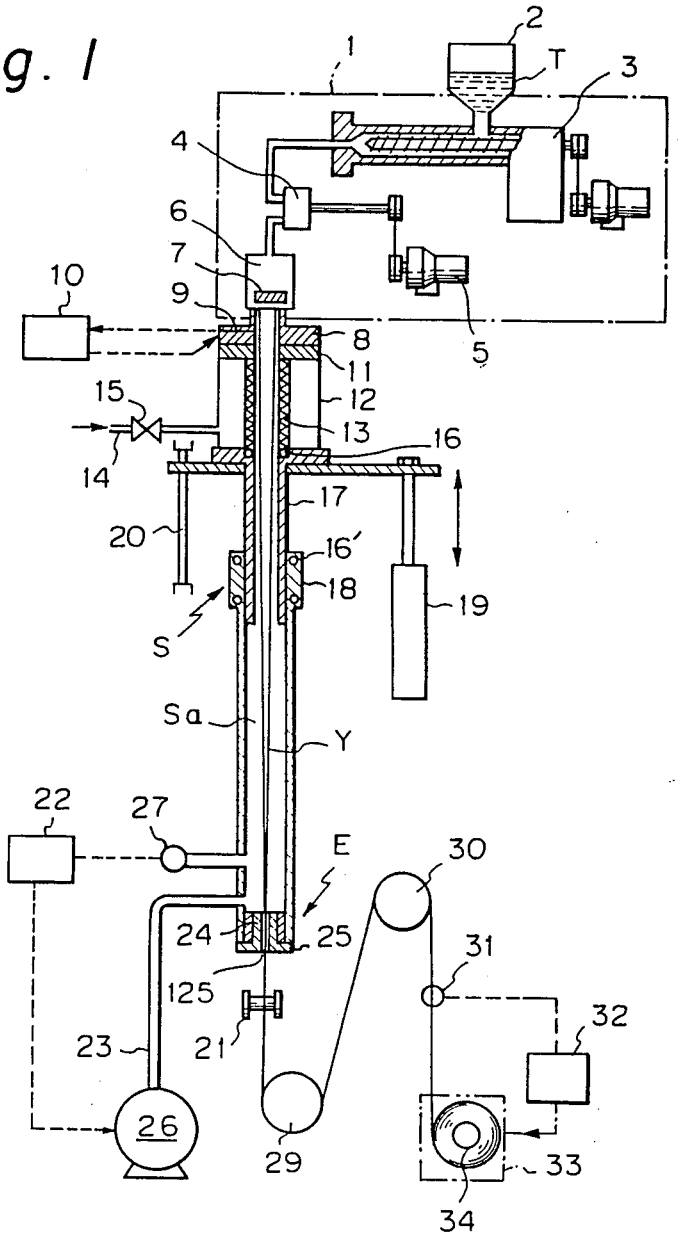
FIG. 1 is a side sectional view of a spinning apparatus according to the present invention.

In FIG. 1, a spinning apparatus according to the present invention includes a melt-spinning device 1 including a hopper 2 for accommodating polymer chips T, an extruder 3, a metering pump 4, a variable speed motor 5, a spinning body 6, and a spinneret 7.

The polymer chips T in the hopper 2 are melted and supplied to the metering pump 4 through the extruder 3. The molten polymer passes through a filter (not shown) in the spinning body 6 and, finally, is extruded from the spinneret 7 as a filament yarn Y at a temperature of from a melting point Tm of the polymer to (Tm+100)°C. The extrusion rate of the molten polymer from the spinneret 7 can be controlled by the metering pump 4 which, in turn, is controllable by the rotation of the variable speed motor 5.

According to the present invention, there is provided a spinning tube S directly beneath the spinning body 6 in which the spinneret 7 is secured, the interior of the spinning tube S is maintained at a low pressure by discharging a gas, usually air, contained therein.

A structure of spinning tube S will not be described in detail. A heating tube 8, if necessary, may be provided beneath the spinneret 7. Beneath the heating tube 8 is secured, via an insulating member 11, an annular chimney 12 for introducing cooling air into the spinning tube S. The heating tube 8 is effective when a high viscosity molten polymer is spun for the production of industrial material, but may be eliminated when a low viscosity molten polymer is extruded for the production of clothing material. The heating tube 8 is provided with a thermometer 9 for detecting the temperature within the heating tube 8. The thermometer 9 is connected to a temperature controller 10 so that the temperature within the heating tube 8 can be maintained at a preset value by means of a heater (not shown) built in the heating tube 8. Under normal spinning conditions, the temperature of the heating tube 8 is maintained within a range of from (Tm−40)°C. to (Tm+100)°C., wherein Tm stands for a melting point of the polymer treated, and the length of the heated zone comprising the heating tube 8 is within a range of from 5 to 100 cm.

The annular chimney 12 is provided with a cylindrical porous filter 13 which uniformly distributes the cooling air fed from an inlet conduit 14 through the entire circumference thereof of the chimney 12. The air inlet conduit 14 has a flow regulator 15 for adjusting the air flow rate.

Figure 2:
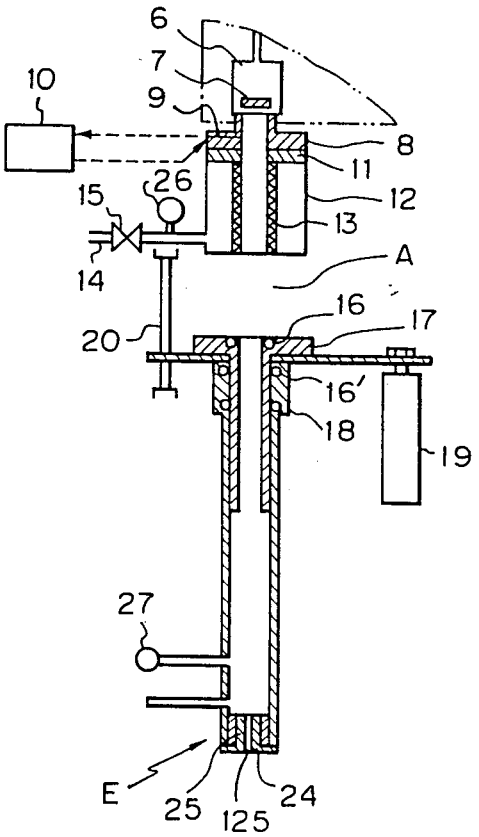
FIG. 2 is a side sectional view of main part of the spinning apparatus shown in FIG. 1, illustrating a detaching position of the spinning tube.

A main portion of the spinning tube S disposed beneath the annular chimney 12 is formed as a double tube including a movable body 17 and a stationary body 18, both of which are telescopically movable with respect to each other so that the movable body 17 can be lowered from a first position shown in FIG. 1 to a second position shown in FIG. 2 in the axis direction within the stationary body 18 in accordance with the operation of a power cylinder 19 secured to the movable body 17. Namely in the case of periodic replacement or cleaning of the spinneret 7, correction of yarn breakage, or starting of the spinning, the movable body 17 is lowered to form an access space A for a worker between the bottom of the annular chimney 12 and the top of the movable body 17 (see FIG. 2). For normal spinning, the movable body 17 is lifted up so that it is pressed onto the annular chimney 12 for a fluid-tight seal therebetween. To ensure this fluid-tight seal, O-rings 16, 16' are provided in the thrust portion between the movable and stationary bodies 17 and 18 and in the contact area between the movable body 17 and the annular chimney 12.

In the embodiment illustrated in FIGS. 1 and 2, the movable body 17 can be moved in the axial direction relative to the upper portion of the spinning tube S. This structure is advantageous because, even if the movable body 17 is detached from the upper portion, the yarn path from the spinneret 7 to a yarn exit is not disturbed thereby and a worker may perform his job while keeping the yarn in a running state. Of course, other directional displacements of the movable body 17 can be adopted, for example, in the transverse direction to the yarn path. Further, if the total length of the spinning tube S is short, the tube S need not be formed as two parts 17 and 18, but may be formed as a single displaceable part.

Figure 3A:
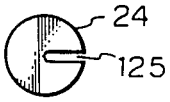
FIGS. 3*a* and 3*b* are plan and side views of a plug having a columnar shape.
Figure 3C:
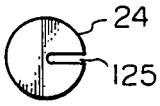
FIGS. 3*c* and 3*d* are plan and side views of a plug having a plate shape.
Figure 3B:
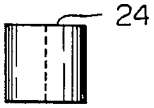
Figure 3D:
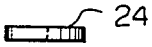

A bottom sealing body E, as shown in FIGS. 1 and 2, is provided at the lowermost end of the stationary body 18, sealing body E includes a tubular member 25 having an opening bored through the axis thereof and a plug 24 inserted into the opening of the tubular member 25. A plug 24 having a columnor shape is shown in FIGS. 3*a* and 3*b*, and a plug 24 having a plate shape is shown in FIGS. 3*c* and 3*d*. Other types of bottom sealing body E will be described later more in detail.

The plug 24 has a slit-like axis groove 125, through which yarn can pass with a small width-wise clearance but through which gas in the outer air is prevented from leaking due to a pressure loss along the groove 125. When the dimensions of the groove 125 are properly selected, the spinning tube S can be substantially completely sealed except for a minimal amount of air reversely flowing into the interior thereof through a small clearance between the withdrawn yarn and the wall of the groove 125, whereby vibration of the yarn and entanglement of the filaments, which often occur when an air flow exists, can be avoided. A pressure gauge 27 and air extracting conduit 23 are provided at the lower portion of the stationary body 18. The conduit 23 is connected to a vacuum pump 26 for discharging the interior air of the spinning tube S.

According to the above structure, a space Sa sealed from the outer air and kept in a decompressed state is readily obtainable beneath the spinneret 7 merely by pressing the movable body 17 onto the annular chimney 12.

The pressure and flow rate of the cooling air supplied into the interior of the sealed space Sa can be controlled by the operation of a valve 15 provided at the inlet portion of the annular chimney 12.

The operation of the apparatus will be described below. The molten polymer is extruded from the spinneret 7, as a filament yarn Y, into the sealed space Sa and passes through a hot zone provided by the heating tube 8 maintained at a preset temperature by means of the temperature controller 10. Thereafter, the yarn Y is cooled by coiling gas (usually air) supplied from the annular chimney 12.

The yarn is completely cooled and solidified while it runs through the movable body 17 and the stationary body 18. Thereafter, the yarn is withdrawn from the sealed space Sa through the groove 125 of the bottom sealing body E with the aid of a first godet roller 29 and a second godet roller 30, both provided outside of the sealed space and rotating at a constant peripheral speed. Oil is imparted by an oiling device 21 to the yarn while it is wound on a bobbin 34 set on a take-up device 33. In this connection, the rotational speed of the bobbin 34 on the take-up device 33 is controlled by a controller 32 in such a manner than a winding tension of the yarn Y is kept constant by a known feedback control system based on the yarn tension detected by a tension detector 31 disposed between the second godet roller 30 and the take-up device 34.

According to the present invention, the interior pressure of the sealed space Sa can be maintained at a desired constant value by adjusting the volume of air supplied into the sealed space Sa and by controlling the ON-OFF operation of the vacuum pump 26 with the aid of the pressure gauge 27 and the controller 22. The interior pressure of the spinning tube is preferably not higher than 0.7 atm, more preferably, not higher than 0.5 atm.

According to the above embodiment, the yarn Y is taken up on the bobbin 34 after the spinning tension is relaxed by means of the godet rollers 29 and 30. However, another take-up system can be adopted, such as a so-called "direct spin-draw" system, in which the yarn is drawn once or twice by a plurality of godet rollers before being taken up.

The yarn produced from the above apparatus has good mechanical properties. This is because the molten polymer flow is cooled gradually in the decompressed atmosphere and thus the formation of a clear skin-core structure of the fiber body is prevented. Since the air in the spinning tube S is continuously replaced with fresh air by the introduction of the cooling air from the annular chimney 12, heat radiated from the yarn and monomer and oligomer separated from the molten polymer is smoothly exhausted from the interior of the spinning tube S together with the discharged cooling air, and thus any elevation of the temperature spinning tube and precipitation of the monomer and oligomer are avoided.

Structure of Bottom Sealing Body

Next, other types of bottom sealing bodies according to the present invention will be described with reference to the drawings.

Figure 4:
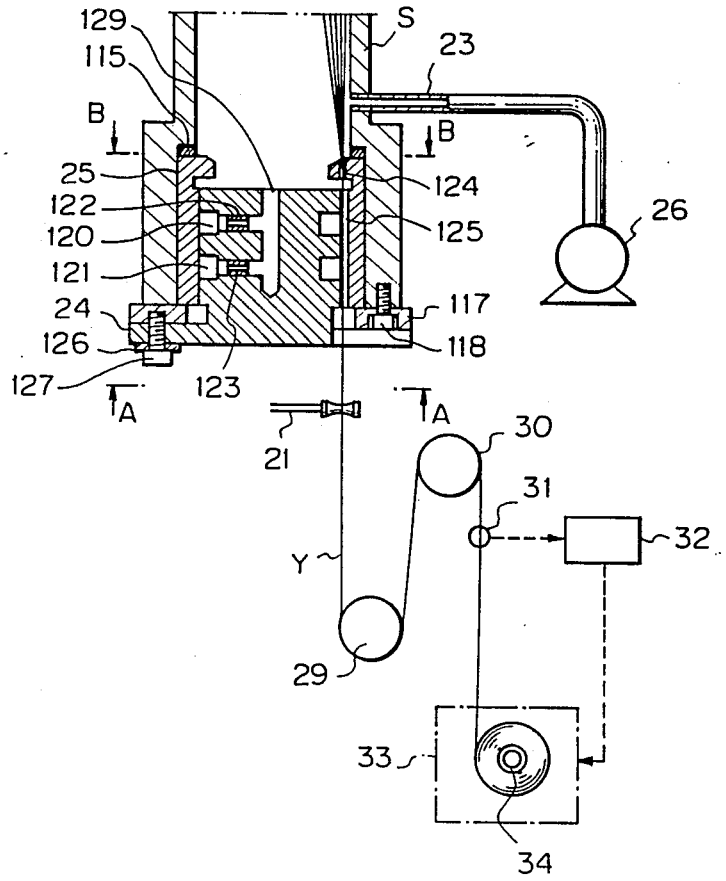
FIG. 4 is a side sectional view of a further embodiment of a bottom sealing body of a spinning tube according to the present invention.
Figure 5:
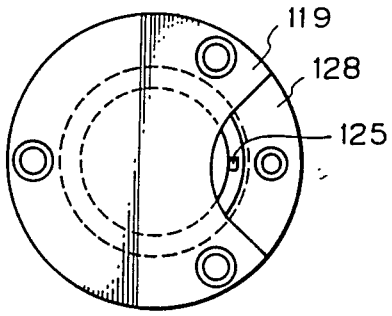
FIG. 5 is a plan view of the bottom sealing body of FIG. 4, taken along line A—A of FIG. 4.
Figure 6:
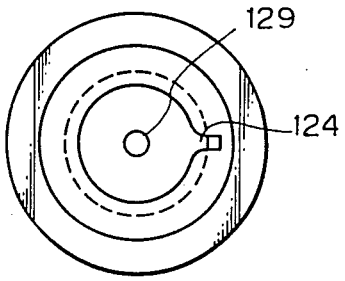
FIG. 6 is a plan view of the bottom sealing body of FIG. 4, taken along line B—B of FIG. 4.

FIGS. 4, 5, and 6 illustrate one embodiment of the bottom sealing body E. A tubular member 25 having a central through-opening is detachably secured to the lowermost end of the spinning tube S, via a resilient member 115, such as a rubber ring. The tubular member 25 is provided with a narrow groove 125 on the inner wall thereof along the axis of the spinning tube S, which groove 125 has a cross-sectional area sufficient to allow the yarn to pass therethrough. The columnar plug 24 has a notched portion 128 at the lowermost end thereof, through which portion 128 the yarn can pass (FIG. 4). The plug 24 is tightly inserted into the tubular member 25, and secured with a flange 117, via a resilient member 126, such as a rubber ring, by means of a screw 127. On the outer wall of the plug 24, a plurality of annular recesses are provided, along the periphery thereof, to form regulating chambers 120 and 121 in cooperation with the inner wall of the tubular member 25. Each of the regulating chambers 120 and 121 communicates, through orifices 122 and 123, respectively, with a central bore 129 provided along the center axis of the top wall of the plug 24. The bore 129, in turn, communicates with the interror atmosphere of the spinning tube S.

A conduit 23 is secured to the outer wall of the spinning tube S, through which the interior of the spinning tube S communicates with a suction pump 26, whereby the interior pressure of the spinning tube S is maintained at a decompressed condition relative to the outer air. The interior pressure of the spinning tube S is detected by a pressure gauge 27 as shown in FIG. 1, which transmits a signal of the detected pressure to a controller 22. The controller 22 is electrically connected to the vacuum pump 26 and controls the pump 26 in such a manner that the interior of the spinning tube S is always kept at a predetermined decompressed pressure. The vacuum pump 26 may be replaced by other means, such as a blower.

The cross-sectional configuration of the narrow groove 125 is not necessarily limited to a rectangular shape as illustrated in FIG. 5 but may be any optional shape, such as triangular, circular or oval, provided the area thereof is the minimum sufficient to permit the filament yarn spun from the spinneret 7 to pass freely therethrough.

The material of the tubular member 25 and the plug 24 is preferably a ceramic which has an excellent durability against frictional wear and, therefore, can always maintain a smooth surface of the yarn.

Moreover, the tubular member 25 and the plug 24 need not be formed in a circular cross-section as illustrated in FIGS. 4 and 5 but may be polygonal, such as triangular, provided a fluid-tight insertion can be obtained between both members 24 and 25.

In the embodiment of FIGS. 4, 5, and 6, the groove 125 for withdrawing the yarn from the interior of the spinning tube S is provided on the inner wall of the tubular member 25. However, the groove 125 may be provided on the outer wall of the plug 24 or on both of the members 24 and 25.

The width and depth of the groove 125 should be decided in accordance with the thickness of the yarn and/or the pressure to be established in the spinning tube S. Generally, it is preferable that the depth of the groove be larger than the width thereof, to avoid catching of the yarn between the mating surfaces of the tubular member 25 and the plug 24.

Figure 11:
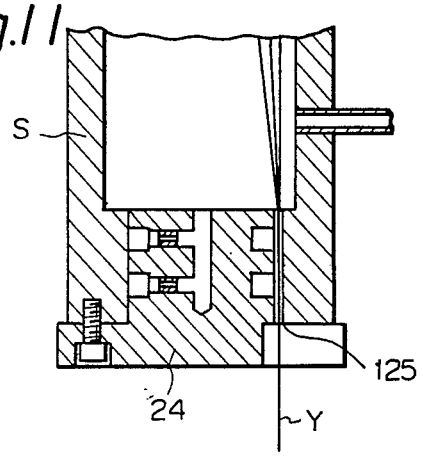
FIG. 11 is a side sectional view of further embodiment of the bottom sealing body of the spinning tube.

Further, instead of eliminating the tubular member 25, the bottom portion of the spinning tube S may directly accommodate the plug 24 as illustrated in FIG. 11.

The inner surface of the groove 125 is finished in such a manner that the yarn is protected even if it touches the surface of the groove. For enhancing this yarn protection effect, the bottom sealing body E may be provided with oiling means instead of the oiling device 21 disposed outside of the bottom sealing Body E. According to this oiling means, frictional resistance between the wall of the groove and the yarn is decreased and also coherency of the filaments composing the yarn can be improved, which results in a stable running of the yarn.

Figure 12:
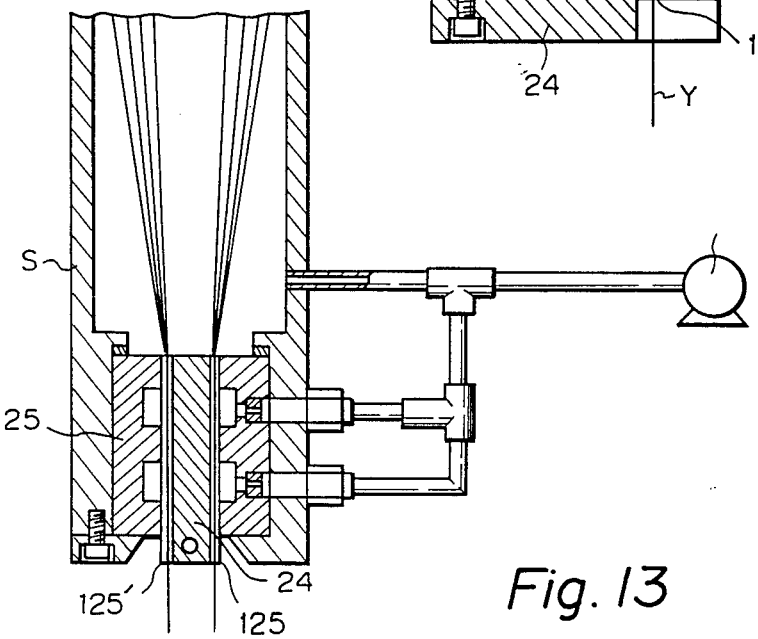
FIGS. 12 and 13 is side sectional and plan views of still further embodiment of the bottom sealing body of the spinning tube.
Figure 13:
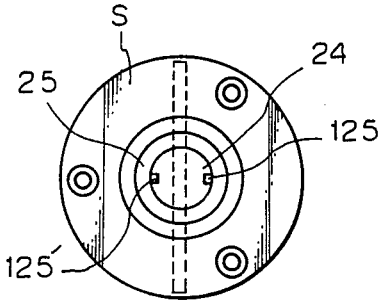

In the case of a multiple-yarn spinning apparatus, in which multifilaments spun from a single spinneret are divided into a plurality of yarns, each of which is individually withdrawn from the spinning tube, the bottom sealing body E according to the present invention may be used by changing the plug 24 to one having a plurality of grooves 125 and 125', each corresponding to respective divided yarns, as illustrated in FIGS. 12 and 13.

In order to ensure the desirable sealing effect of the bottom sealing body E, according to experiments by the present inventors', the cross-sectional area of the groove 125 is preferably not more than 4.0 mm per individual groove, more preferably not more than 0.7 mm.

In the threading operation during the start-up of the apparatus, the filaments spun form the spinneret 7 are taken up by a suction gun (not shown) through a bottom opening of the spinning tube S, which opening is provided by removing the plug 24 from the tubular member 25. The yarn Y is then introduced into a yarn guide 124 disposed just above the top end of the groove 125. The yarn guide 124 has a shape and size similar to that of the groove 125, and serves to prevent the filaments from spreading and touching the wall of the groove 125. The yarn is then fitted in the groove 125 by the manual operation of the suction gun. Thereafter the plug 24 is inserted into the tubular member 25 and both are fixedly secured to the bottom of the spinning tube S by means of the screw 127. The interior of the spinning tube S is then set to a predetermined pressure. Finally, the yarn Y withdrawn from the interior of the spinning tube S is transferred to the take-up means 34 in the conventional manner. Thus, the threading operation is completed.

The bottom sealing body E substantially seals the interior of the spinning tube S against the ingress of the outer air due to the pressure loss of the groove 125 having the minimum diameter that will allow the yarn to pass through.

Next, the function and effect of the regulating chambers 120 and 121 will be explained in more detail.

Generally speaking, when the interior pressure of a sealed space, such as the spinning tubes reaches a certain low value, which is referred to as the "critical pressure", the speed of an air stream flowing into the sealed space through the groove 125, from the outer air is almost equal to sonic velocity. Under such circumstances, even if the interior pressure of the spinning tube is further decreased, the pressure of the air stream is kept at the same value as the critical pressure, while the speed thereof is unchanged. Therefore, a step-like pressure difference exists inside of the spinning tube in the vicinity of the opening of the groove 125. According to this pressure difference, the sorc speed air stream flowing into the spinning tube S from the groove 125 is rapidly expanded and generates a repeated pressure pulsation near the inlet of the groove 125.

Because of this pressure pulsation, the filaments of the yarn prior to introduction to the groove 125 are vigorously vibrated and separated from each other, which instantaneously causes the respective filaments to become entangled with each other and prevents a smooth spinning operation.

To solve the above problem, the bottom sealing body of the present invention is provided with the regulating chambers 120 and 121. That is, as illustrated in FIG. 4, the regulating chambers 120 and 121 communicate with the interior of the spinning tube S, wherein the pressure P0 is kept at a predetermined low value, through the common central bore 129 and orifices 122 and 123 branched therefrom. The sizes of the orifices 122 and 123 are adapted so that the pressures in the regulating chambers 120 and 121 are regulated to the values P1 and P2, respectively, which are the intermediate values between the outer air pressure and the interior pressure of the spinning tube; P1 being larger than P2. These pressures are transmitted to midportions of the groove 125, and the air stream flowing into the spinning tube through the groove 125 is forcibly damped, whereby the pressure pulsation of the air stream is avoided.

Figure 7:
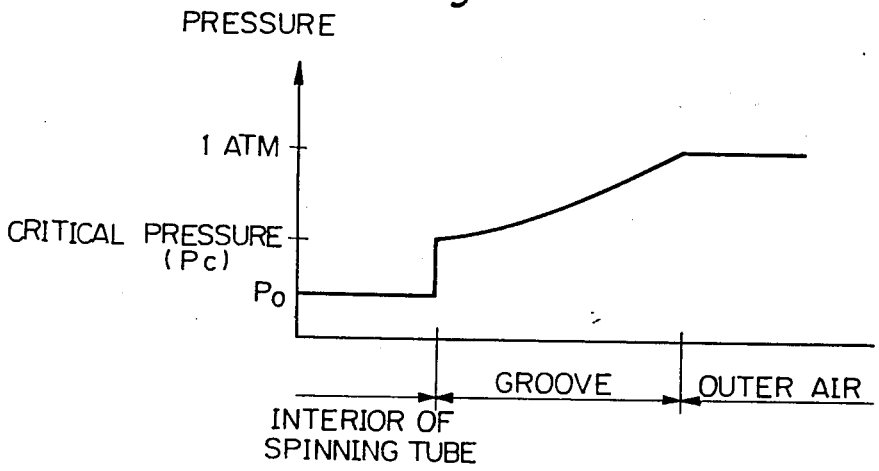
FIG. 7 is a diagram illustrating pressure distribution around a bottom sealing body without a pressure regulating means.
Figure 8:
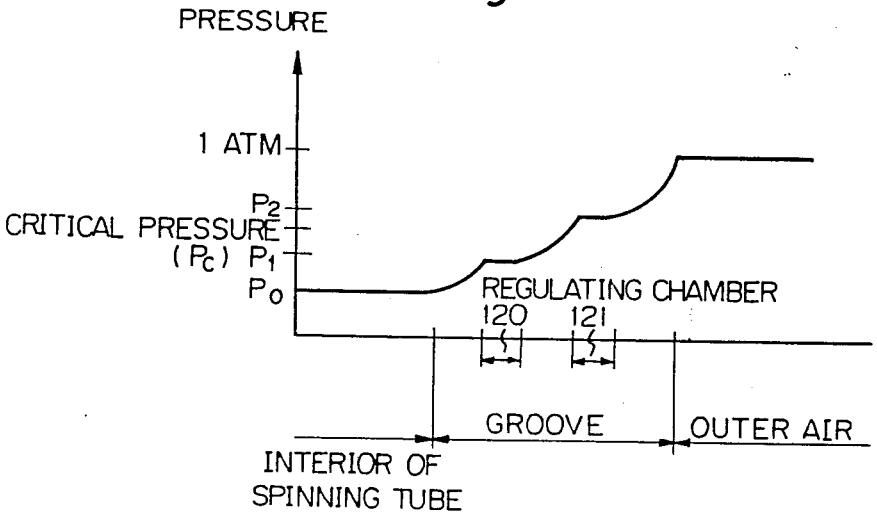
FIG. 8 is a diagram similar to FIG. 7 but wherein the bottom sealing body has a pressure regulating means.

The pressure distributions around the bottom sealing body E are illustrated in FIGS. 7 and 8, respectively, both with and without the regulating chambers according to the present invention. As shown in FIG. 7 where there are no regulating chambers, the pressure shows little drop through the groove 125 and the pressure in the vicinity of the inlet of the groove 125 is kept at the critical pressure Pc, and thus the pressure gap from the interior pressure P0 of the spinning tube causes the above-mentioned pressure pulsation. On the other hand, as shown in FIG. 8, where the regulating chambers are provided, the pressure in the groove 125 is stepwisely reduced due to the provision of these regulating chambers 120 and 121, and, finally, the pressure gap around the inlet of the groove 125 is minimized, whereby the disturbance of the air stream in the spinning tube is eliminated.

In the embodiment shown in FIG. 4, the orifices 122 and 123 having different diameters from each other are utilized for regulating the pressures in the regulating chambers 120 and 121, respectively. Alternatively, orifices having an identical diameter but different lengths may be adopted for establishing the predetermined pressure difference therebetween. Further, the regulating chamber having an annular shape may be eliminated and, instead, other pressure regulating means, such as a conduit having an orifice may be directly opened to each groove of the bottom sealing body.

Figure 9:
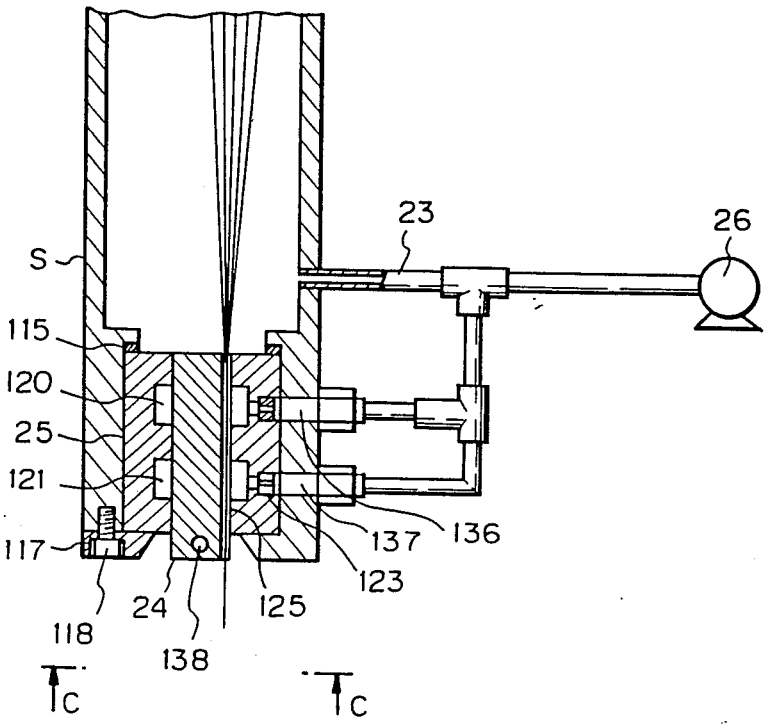
FIG. 9 is a side sectional view of another embodiment of the bottom sealing body of the spinning tube according to the present invention.
Figure 10:
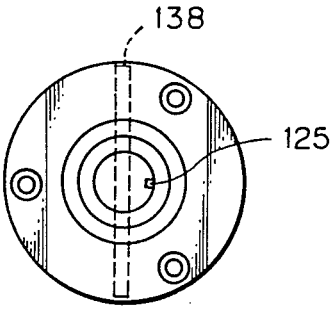
FIG. 10 is a plan view of the bottom sealing body shown in FIG. 9 taken along line C—C of FIG. 9.

FIG. 9 illustrates another embodiment of the bottom sealing body E. In this embodiment, the groove 125 is axially provided on the outer wall of the plug 24. The plug 24 is inserted into the opening of the tubular member 25 and held therein with a pin 138. The tubular member 25 is secured to the bottom of the spinning tube S, via a resilient member 115, such as a rubber ring, by means of a flange 117 and a screw 118. The regulating chambers 120, 121 and the orifices 122, 123 communicating, respectively, therewith, are all provided on the tubular member side. Each of the orifices 122 and 123 is independently connected, through apertures 136 and 137, respectively, to the extracting conduit 23 communicating with the vacuum pump 26 for maintaining the interior pressure of the spinning tube S. Due to this structure, the pressures in the regulating chambers 120 and 121 are adjusted to intermediate pressure values between those of the spinning tube and the outer air. Instead of the common vacuum pump, the regulating chambers 120 and 121 may have an independent vacuum source, respectively. In the latter case, the orifice may be omitted and the pressure in the regulating chamber may be adjusted by controlling the respective vacuum source. Of course, the number of grooves 125 is not limited to one, as described above, but may be increased in accordance with the number of yarns to be withdrawn from the spinning tube.

Polymers Usable for the Invention

Thermoplastic polymers usable for the present invention are those which can form a fiber under usual melt-spinning conditions, for example, polyamide, such as poly-capramide, polyhexamethylene adipamide, polyhexamethylene sebacamide, polytetramethylene adipamide, polyhexamethylene terephthalamide, polyhexamethylene isophthalamide, polydodecamethylene dodecamide, polymetaxylene adipamide, polyparaxylylene adipamide, poly-11-aminoundecanoic acid; polyester, such as polyethylene terephthalate, polytetramethylene terephthalate, polyethylene 1,2-diphenoxyethane PP'-dicarboxylate, polynaphthalene terephthalate; polyolefin, such as polyethylene, polypropylene, polybutene-1; polyfluorovinylidene; polyfluoroethylenepolyfluorovinylidene copolymer; polyvinyl chloride; polyvinyliden chloride; and polyacetal. These polymers may be utilized independently or in the form of a copolymer or mixed polymer.

Method for Producing Polyester Yarn

Features of the present invention when applied to production of a polyester yarn will now be described.

According to experiments by the present inventors, polyester fibers having excellent mechanical properties are obtained in a stable condition by the above-mentioned decompressed atmospheric spinning. The withdrawing speed of the yarn from the spinning tube is preferably not less than 4,000 m/min and the temperature of the yarn at the exit portion of the bottom sealing body is preferably lower than $(T_A+20)$°C. wherein $T_A$ stands for the temperature of the outer air.

EXAMPLE 1

Polyethylene terephthalate polymer having an intrinsic viscosity of 0.63 was melt-spun under a spinning temperature of 300° C. by means of the apparatus illustrated in FIG. 1. A length of the heating tube beneath the spinneret was 200 mm. Molten polymer was extruded from the spinneret having 24 nozzle holes each 0.2 mm in diameter at a rate of 33 g/min. A spinning tube having a length of 3.5 m was disposed beneath the heating tube via the insulating member having a thickness of 40 mm. Various runs were carried out while changing the interior pressure of the spinning tube to various levels, but maintaining the yarn temperature at the exit portion of the bottom sealing body at a constant value in a range of from 20° C. to 30° C. (the temperature of the outer air was 20° C.). The characteristics of various samples obtained from the runs were measured and are listed in Table 1.

The test methods were as follows:

1. Breakage strength

The stress strain curve was obtained by means of a "Tensilon" elongation tester supplied by Toyo-Baldwin K.K., Japan, and the breakage strength was calculated therefrom. For a yarn produced under a withdrawing speed of less than 5,000 m/min, the test length was 50 mm and the elongation rate was 200 mm/min. For a yarn produced under a withdrawing speed of not less than 5,000 m/min, the test length was 200 mm and the elongation rate was 100 mm/min.

2. Birefringence Δn

Birefringence was measured as a parameter of molecular orientation in accordance with a compensator method by utilizing a monochromatic light of the D line of Na.

3. Density

Density was obtained by means of a density gradient tube utilizing η-heptane as a light liquid and tetrachloromethane as a heavy liquid.

4. Dry heat contraction

A sample yarn was reeled ten times to form a hank. A length L0 of the hank was measured under a load of 0.1 g/d and then heat-treated in an oven maintained at 160° C. for 15 min. Thereafter, the length L1 of the hank was again measured under the same load as before. A dry heat contraction ΔSd was obtained by the following equation:

$$\Delta Sd = \frac{L0 - L1}{L0} \times 100\ (\%)$$

TABLE 1

| Run No. | Withdrawing speed (m/min) | Interior pressure of spinning tube (atm) | Strength (g/d) | Birefringence ($\times 10^{-3}$) | Density (g/cm$^3$) | Dry heat contraction (%) | Spinning stability |
|---|---|---|---|---|---|---|---|
| 1 | 4,000 | 1 | 3.4 | 86.5 | 1.3442 | 45.3 | slightly inferior |
| 2 | 4,000 | 0.66 | 3.7 | 106.4 | 1.3586 | 5.9 | good |
| 3 | 4,000 | 0.39 | 3.8 | 104.4 | 1.3594 | 5.2 | good |
| 4 | 5,000 | 1 | 3.5 | 95.0 | 1.3623 | 5.4 | bad |
| 5 | 5,000 | 0.66 | 4.2 | 120.1 | 1.3712 | 5.0 | good |
| 6 | 5,800 | 1 | 4.0 | 110.3 | 1.3773 | 4.6 | bad |
| 7 | 5,800 | 0.86 | 4.1 | 117.5 | 1.3776 | 4.6 | bad |
| 8 | 5,800 | 0.66 | 4.4 | 125.8 | 1.3795 | 4.2 | good |

As apparent from Table 1, run Nos. 1, 4, 6, and 7 carried out under the higher atmosphere of not lower than 0.7 atm showed an inferior workability compared to those according to the present invention. Further, since the birefringence $\Delta n$ and the density of the samples were elevated in the latter, the mechanical properties thereof, were also improved.

EXAMPLE 2

Runs were carried out under the same conditions as run No. 8 of the Example 1 except that the length of the heating tube was varied. Characteristics of the samples obtained from the runs were measured and are listed in Table 2.

According to the results, the birefringence and the breakage strength are degraded in the case of run Nos. 11 and 12. This means that the length of the heating tube is preferably more than 50 mm.

TABLE 2

| Run No. | Length of heated zone (mm) | Strength (g/d) | Dry heat contraction (%) | Birefringence ($\times 10^{-3}$) |
|---|---|---|---|---|
| 8 | 200 | 4.4 | 4.2 | 125.8 |
| 9 | 150 | 4.2 | 4.5 | 120.3 |
| 10 | 100 | 4.2 | 4.6 | 121.2 |
| 11 | 50 | 3.9 | 5.5 | 104.0 |
| 12 | 30 | 3.7 | 6.1 | 95.8 |

EXAMPLE 3

Runs were carried out under the same conditions as run No. 8 of Example 1 except that the length of the spinning tube was varied so as to control the temperature of the yarn at the exit portion of the bottom sealing body to various levels. Characteristics of the samples obtained from the runs were measured and are listed in Table 3.

As shown in Table 3, the mechanical properties of the yarn are inferior when the temperature of the yarn at the exit portion of the spinning tube is more than 20° C. higher than that of the outer air temperature.

TABLE 3

| Run No. | Yarn temperature at exit portion of spinning tube (°C.) | Temperature of outer air (°C.) | Strength (g/d) |
|---|---|---|---|
| 8 | 25 | 20 | 4.4 |
| 13 | 35 | 22 | 4.3 |
| 14 | 45 | 21 | 4.2 |
| 15 | 60 | 24 | 4.0 |
| 16 | 85 | 22 | 3.9 |

EXAMPLE 4

Runs were barried out by using two kinds of polyester polymer A and B under the same conditions as for Example 1, except that the withdrawing speed was set at a constant value of 6,000 m/min and the interior pressure of the spinning tube was regulated to three levels.

Polymer A contained 0.5 weight % of titanium oxide as a delusterant and polymer B was free therefrom. Characteristics of the samples obtained by the runs were measured and are listed in Table 4. As apparent from Table 4, the crystallization degree of the samples was improved by the depressed pressure of the spinning tube. This tendency is especially remarkable in the case of a thinner yarn rather than a coarser yarn. Further, even polymer B, which is usually difficult to crystallize under high speed spinning conditions, showed good results.

In Example 4, the crystallization degree $X_c$ was calculated by the following equation:

$$\rho = \rho_c X_c + (1 - X_c)\rho_a$$

wherein $\rho$ stands for a density of a sample yarn;

$\rho_c$ for a density of a crystallized portion (1.455); and $\rho_a$ for a density of an amporphous portion (1.335).

Method for Producing Polyamide Yarn

Next, the features of the present invention when applied to the production of a polyamide yarn will be described by the following examples.

TABLE 4

| Run No. | Polymer | Extrusion rate (g/min) | Yarn thickness (denier) | Interior pressure of spinning tube (atm) | Density (g/cm$^3$) | Crystallization degree (%) |
|---|---|---|---|---|---|---|
| 17 | A | 21.0 | 31.5 | 1 | 1.369 | 28 |
| 18 | | | | 0.66 | 1.373 | 32 |
| 19 | | | | 0.39 | 1.376 | 35 |
| 20 | B | | | 1 | 1.367 | 26 |
| 21 | | | | 0.66 | 1.371 | 30 |
| 22 | | | | 0.39 | 1.373 | 32 |
| 23 | | 33.7 | 50.6 | 1 | 1.372 | 31 |
| 24 | | | | 0.66 | 1.374 | 33 |

TABLE 4-continued

| Run No. | Polymer | Extrusion rate (g/min) | Yarn thickness (denier) | Interior pressure of spinning tube (atm) | Density (g/cm$^3$) | Crystallization degree (%) |
|---|---|---|---|---|---|---|
| 25 | | | | 0.39 | 1.376 | 34 |

EXAMPLE 5

Polycapramide polymer having a viscosity of 2.62 relative to sulfuric acid and containing 0.3 weight % of titanium oxide was melted at 265° C. and spun by means of the apparatus shown in FIG. 1 through a spinneret having 24 nozzle holes each 0.3 mm in diameter. Runs were carried out under conditions of a constant withdrawing speed of 4,000 m/min while varying the extrusion rate to three levels of 45 g/min, 30 g/min, and 15 g/min, respectively, and the interior pressure of the spinning tube to three levels of 0.65 atm, 0.39 atm, and 0.33 atm, respectively. An aqueous emulsion was imparted to the resultant yarns as a spinning oil. Further, the amount of cooling air introduced from the annular chimney in the spinning tube was regulated to three levels of 400 Nl/min, 300 Nl/min, and 200 Nl/min, respectively. As a comparative example, runs under the same conditions, except that the interior of the spinning tube was maintained at the normal atmosphere, were carried out.

The test results are listed in Table 5. As apparent from the table, the samples obtained from runs according to the present invention had an excellent uniformity and mechanical properties.

TABLE 5

| Run No. | Interior pressure of spinning tube (atm) | Amount of cooling air (Nl/min) | Yarn thickness (denier) | Strength (g/d) | Elongation (%) | Yarn irregularity (U %) | Remarks |
|---|---|---|---|---|---|---|---|
| 26 | 0.65 | 400 | 105 | 4.5 | 63 | 0.3 | |
| 27 | 1 | 400 | 105 | 4.3 | 55 | 0.7 | |
| 28 | 0.39 | 300 | 70 | 5.1 | 60 | 0.1 | |
| 29 | 1 | 300 | 70 | 4.9 | 57 | 0.5 | |
| 30 | 0.33 | 200 | 35 | 5.3 | 56 | 0.1 | |
| 40 | 1 | 200 | 35 | 4.3 | 47 | 0.7 | Yarn tension was remarkably increased and filament breakage occurred. |
| 41 | 0.33 | 0 | 35 | 4.9 | 52 | 0.3 | Precipitate was recognized in spinning tube. |

EXAMPLE 6

Polycapramide polymer having a viscosity of 3.5 relative to sulfuric acid was melted at 275° C. and spun by means of the apparatus shown in FIG. 1 through a spinneret having 34 nozzle holes each 0.2 mm in diameter under an extrusion rate of 10 g/min, a withdrawing speed of 2,700 m/min, and an interior pressure of the spinning tube of 0.26 atm. An aqueous emulsion was imparted to the resultant yarn as a spinning oil. Results similar to Example 4 were obtained by the above run which are listed in Table 6 together with those of a comparative example carried out under normal atmosphere.

TABLE 6

| Run No. | Interior pressure of spinning tube (atm) | Amount of cooling air (N/min) | Yarn thickness (denier) | Strength (g/d) | Elongation (%) | Yarn irregularity (U %) |
|---|---|---|---|---|---|---|
| 42 | 0.26 | 200 | 35 | 5.1 | 89 | 0.5 |
| 43 | 1 | 200 | 35 | 4.5 | 80 | 1.0 |

We claim:

1. An apparatus for producing a yarn from a thermoplastic polymer, comprising a spinning body having a bottom, a spinneret provided at the bottom of said spinning body, a spinning tube connected to said spinning body in a state wherein its interior is substantially proof against the ingress of outer air and disposing a surface of said spinneret in said spinning tube, a gas extracting conduit connected to said spinning tube to maintain the interior of said spinning tube at a subatmospheric pressure of not more than 0.7 atm, a bottom sealing body provided at a bottom end of said spinning tube substantially sealed against the ingress of outer air, an opening provided in said bottom sealing body, a plug detachably secured to the opening which is substantially proof against the ingress of outer air, at least one groove forming a yarn path provided at the sealed bottom of the spinning tube to allow passage of the yarn therethrough but substantially to prevent the outer air from entering into the interior of said spinning tube, and means, disposed outside of said spinning tube, for withdrawing the yarn from said spinning tube.

2. An apparatus for producing a yarn from a thermoplastic polymer, comprising a spinning body having a bottom, a spinneret provided at the bottom of said spining body, a spinning tube connected to said spinning body in a state wherein its interior is substantially proof against the ingress of outer air and disposing a surface of said spinneret in said spinning tube, a gas extracting conduit connected to said spinning tube to maintain the interior of said spinning tube at a subatmospheric pressure of not more than 0.7 atm, a bottom sealing body provided at a bottom end of said spinning tube substantially sealed against the ingress of outer air, an opening provided in said bottom sealing body, a plug detachably secured to the opening which is substantially proof against the ingress of outer air, at least one groove forming a yarn path provided at the sealed bottom of the spinning tube to allow passage of the yarn therethrough but substantially to prevent the outer air from entering into the interior of said spinning tube, and means, disposed outside of said spinning tube, for withdrawing the yarn from said spinning tube, wherein said groove is in said bottom sealing body and is connected to a pressure regulating means, for adjusting pressure at a portion where said pressure regulating means is opened to said groove to a pressure value in the range of from more than the pressure of the interior of said spinning tube and less than the pressure of the outer atmosphere of said spinning tube.

3. An apparatus defined by claim 1 or 2, wherein an annular chimney encircling a yarn path in said spinning tube is provided at an upper portion in said spinning tube to introduce a cooling gas into said spinning tube to reduce the temperature of the yarn extruded from said spinneret.

4. An apparatus defined in claim 1 or 2, wherein said groove has a cross-sectional area of not more than 4.0 $mm^2$.

5. An apparatus defined by claim 4, wherein said groove has a cross-sectional area of not more than 0.7 $mm^2$.

6. An apparatus defined by claim 1 or 2, wherein means for collectively guiding the yarn is provided near an entrance of said groove in said spinning tube.

7. An apparatus defined by claim 1 or 2, wherein said groove comprises a plurality of grooves.

8. An apparatus defined by claim 1 or 2, wherein said groove has a length within a range of from 2 mm to 50 mm.

9. An apparatus defined by claim 1 or 2, wherein the means for withdrawing the yarn from said spinning tube comprises a godet roller.

* * * * *